United States Patent [19]

Daniels

[11] 3,937,144

[45] Feb. 10, 1976

[54] INTERNAL STABILIZING DEVICE FOR AIR AND WATER MISSILES

[75] Inventor: Peter Daniels, Fredericksburg, Va.

[73] Assignee: The United States of America as represented by the Secretary of the Navy, Washington, D.C.

[22] Filed: July 3, 1972

[21] Appl. No.: 268,346

[52] U.S. Cl. ..... 102/2; 244/3.1

[51] Int. Cl.[2] ..... F42B 25/00

[58] Field of Search ..... 102/1, 2, 3, DIG. 3; 244/3.1; 89/1.808

[56] References Cited

UNITED STATES PATENTS

| | | | |
|---|---|---|---|
| 1,316,033 | 9/1919 | Hayden | 244/3.1 |
| 1,316,363 | 9/1919 | Hayden | 244/3.1 |
| 2,402,718 | 6/1946 | Albree | 244/3.1 |
| 2,406,293 | 8/1946 | Hammond, Jr. | 102/3 |
| 2,691,495 | 10/1954 | Chiroky | 244/3.1 |
| 2,729,106 | 1/1956 | Mathiesen | 102/DIG. 3 |
| 2,849,955 | 9/1958 | Smathers | 89/1.808 X |
| 2,960,876 | 11/1960 | Saphra | 102/DIG. 3 |
| 3,610,096 | 10/1971 | Bauman et al. | 89/1.808 |

*Primary Examiner*—Charles T. Jordan

[57] ABSTRACT

An apparatus and method for reducing the launch disturbance of a weapon store on a supersonic aircraft is disclosed. The apparatus comprises a flywheel rotatably mounted within the store. The flywheel is prespun before launch using internal rockets or ram air. The spining flywheel produces a gyroscopic effect which appreciably reduces launch disturbance and therefore increases accuracy.

1 Claim, 2 Drawing Figures

INTERNAL STABILIZING DEVICE FOR AIR AND WATER MISSILES

BACKGROUND OF THE INVENTION

Aircraft store separation is a serious consideration for both weapon and aircraft designers. The weapon designer wants to avoid the large release disturbance, since it affects the weapon's accuracy; the aircraft designer wants to avoid the large release disturbance, since it is dangerous to the pilot and can result in damage to the aircraft. Various methods of improving weapon separation characteristics have been employed but none have been entirely satisfactory. The present systems are rather erratic in their separation characteristics due to variation in store configurations.

In retrospect, it is quite unlikely that a store separation problem existed when aircraft flew at 250 knots and dropped 2000 lb. bombs. Due to the inertia loads being much greater than the aerodynamic loads, the bombs were aerodynamically inert at release. However, as aircraft speed increased, the resultant aerodynamic loads increased with velocity squared and store separation became a problem. Weapon accuracy was reduced and aircraft damage sustained.

Aircraft can now carry high density, externally stored weapons supersonically. This invention would allow such weapons to be launched at supersonic speeds by minimizing the release disturbances that are encountered and thereby increasing weapon accuracy and eliminating the danger of damage to the aircraft.

Spinning masses have been employed in the prior art to give stability to rockets. Such devices, however, have not been employed to reduce the launch disturbance which acts on a bomb upon release at high speeds from an aircraft. The bomb itself has no inherent motor power. It moves only when something, a plane or gravity for example, moves it. In this sense it is a nonself-propelling unit. Because it is not a rocket, the need for stability has not been a primary concern of those working with bombs.

SUMMARY OF THE INVENTION

Equations (1), (2) and (3) give the criteria for stabilizing a rocket with an internal spinning mass.

$$S = \frac{(P_1 I_{x1} + P_2 I_{x2})^2}{4\,\tau\, M\alpha} \tag{1}$$

$$\lambda\ 1,2 = \frac{Z\alpha}{2Mv}(1 \pm \tau) + \frac{Mq + M\alpha}{2\,\tau}(1 \pm \tau) \pm \frac{M_{p\alpha}\quad P_1\,\tau}{P_1 I_{x1} + P_2\, I_{x2}} \tag{2}$$

The necessary and sufficient conditions for stability are:

$$\begin{matrix} S > 1 \\ S < 0 \end{matrix} \quad \text{OR } \lambda\ 1,2 < 0 \tag{3}$$

The definitions of the above symbols are contained in the attached appendix. The equations themselves may be derived by employing linear aerodynamics and Frick's equations for motion for two rigid bodies coupled by a bearing as described in his report "Equations of Motion for Two Rigid Bodies Coupled by a Bearing" Naval Proving Ground Report 1630, Nov. 25, 1958.

APPENDIX $I_x, I_y$ = Rolling and Pitching Moments of Inertia
$I_{x1}, I_{x2}$ = Rolling Moment of Inertia of Outer Body and Inner Body
$I_{y1}, I_{y2}$ = Pitching Moment of Inertia of Outer Body and Inner Body
$\tau = I_{y1} + I_{y2} + M_1X_1^2 + M_2X_2^2$
$M$ = Total Configuration Mass
$M_1, M_2$ = Masses of Outer and Inner Bodies
$M_p{}^\alpha$ = Magnus Moment Stability Derivative
$M_q + M\alpha$ = Pitch Damping Moment Stability Derivative
$M\alpha$ = Pitching Moment Stability Derivative
$P_1, P_2, P_3$ = Angular Velocity Components Resolved Along the X, Y, Z Axes
$S$ = Gyroscopic Stability Factor
$t$ = time
$U, V, W$ = Body Liner Velocity Components Resolved Along the X, Y, Z Axes
$X, Y, Y$ = Right Handed Co-Ordinate System Where X is the Axis of Symmetry
$Z_\alpha$ = Normal Force Stability Derivative
$\alpha$ = Complex Angle of Attack
$\alpha_0$ = Complex Angle of Attack at $t = 0$
$\alpha_0$ = Initial Angular Rate
$\lambda_{1,2}$ = Logarithmic Damping Factors $$\tau = 1/\ \sqrt{1 - 1/S}$$

Employing these equations, one can derive equation (4) for the maximum angle of attack due to an angular rate.

$$|\alpha\ \max| = \sqrt{\frac{2\alpha_o}{\frac{(P_1 I_{x1} + P_2 I_{x2})^2}{\tau^2} - \frac{4M\alpha}{\tau}}} \tag{4}$$

Equation 4 shows how much the launch disturbance of a store is damped by the pre-spun mass. This concept is entirely different from the stability concept. For example, suppose a store experiences a large and undesirable angle of attack due to an angular rate. It may be stable or unstable. Its angle of attack is still reduced by increasing the angular momentum of the mass. As seen in equation (4), this result may be achieved by increasing the angular momentum of either the inner or outer bodies of the bomb as represented by $I_{x1}$ and $I_{x2}$. The amount of decrease is governed by equation (4). Stability is another problem entirely.

As equation (4) indicates, the maximum angle of attack due to an angular rate can be reduced by increasing the angular momentum of either an inner or outer body of the weapon store itself. The present invention increases the angular momentum of the weapon store by spinning an internally stored mass rotatably mounted within the bomb itself. Spin-up rockets or ram air devices may be employed to spin the mass before it is released from the aircraft.

OBJECTS OF THE INVENTION

An object of the present invention is the provision of a finless unguided bomb having a means therein to reduce the launch disturbance of such bomb from an aircraft flying at supersonic speeds.

Another object is to provide a bomb whose angular momentum may be increased without spinning the entire outside casing.

A further object of the invention is the provision of a weapon that may be released from an aircraft at supersonic speed without fear of damage to the aircraft.

Other objects, advantages and novel features of the present invention will become apparent from the following detailed description of the invention when considered in conjunction with the accompanying drawings.

DESCRIPTION OF THE PREFERRED EMBODIMENT

Figure 1:
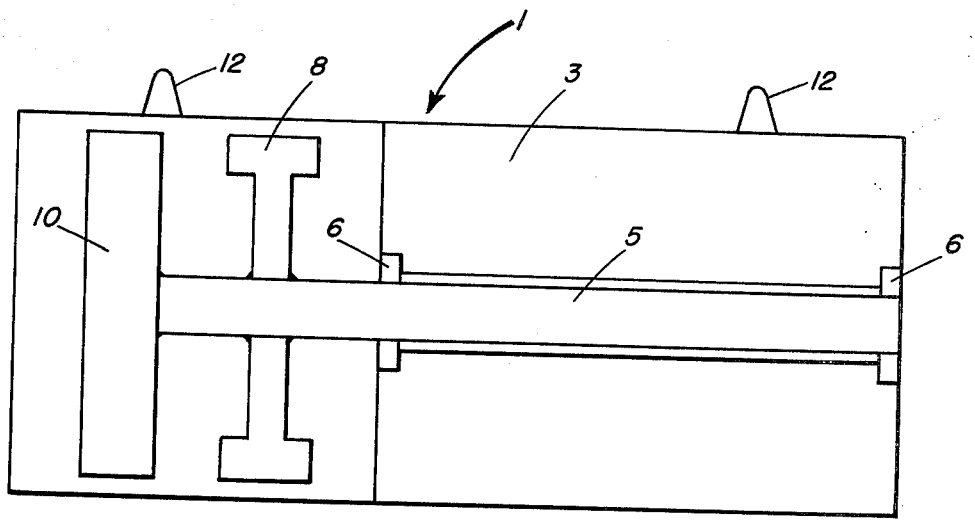
FIG. 1 is a schematic of a preferred embodiment of the invention, depicting generally the construction of a weapon store.

FIG. 1, which illustrates a preferred embodiment of the invention, shows a weapon store 1 having an explosive charge 3 mounted in its forward end. A rotatable shaft 5 is mounted on bearings 6 and passes through the charge 3 which circumscribes the shaft. Flywheel 8 is mounted on the rear of the shaft. When the flywheel is spun, it increases the angular momentum of the weapon store and thus reduces launch disturbance. Block 10 represents the motive power employed to spin flywheel 8 before release. The motive power may consist of an electric motor or starter motor; however, in the invention's preferred embodiment solid rockets are employed.

The outer casing of the weapon store 1 has suspension lugs 12 which are used to mount the store on an aircraft and are released when the weapon store is dropped. Suitable squib type devices may be employed to start the solid propellant rockets 10. Such devices may be ignited by electrical systems (not shown). Moreover, although only one rocket is illustrated, a plurality may be employed and attached to shaft 5.

Figure 2:
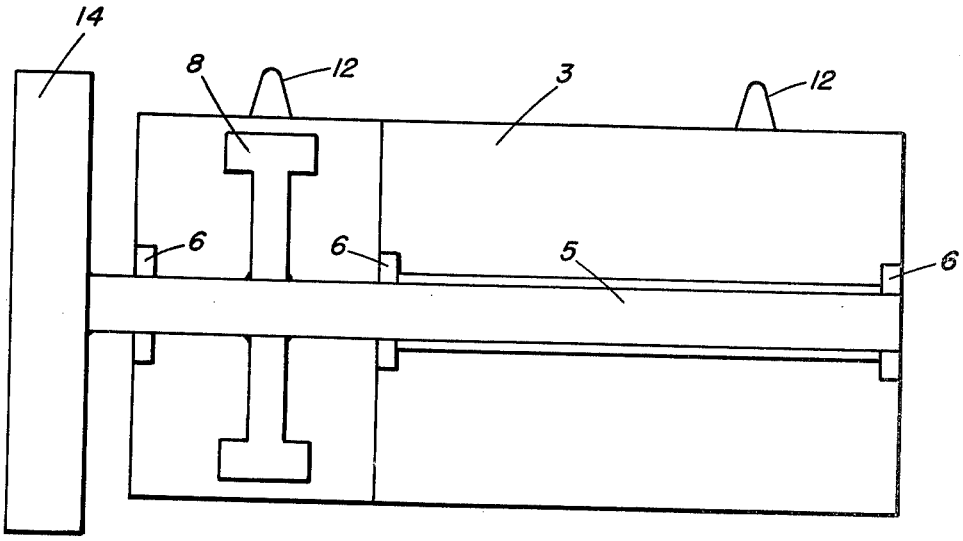
FIG. 2 is a schematic of another embodiment of the invention.

FIG. 2, in which like numerals are employed to indicate like structure, depicts another embodiment of the invention. In FIG. 2 the motive power employed to pre-spin flywheel 8 is a ram air device 14, such as a ram air turbine. Any suitable device which will convert the energy of the ram air into rotational motion of the shaft 5 can of course be employed. The flywheel itself may be made of steel which will fracture upon explosion of the device.

Obviously many modifications and variations of the present invention are possible in light of the above teachings. It is therefore to be understood that, within the scope of the appended claims, the invention may be practiced otherwise than as specifically described.

What is claimed is:

1. A nonself-propelling finless bomb adapted to be carried on and launched from aircraft at supersonic speeds comprising:

a casing having suspension means thereon for mounting the bomb on the aircraft;

an explosive warhead disposed within said casing;

a flywheel fixed to a shaft mounted for rotation within said casing on the longitudinal axis thereof; and means for imparting rotation to said flywheel prior to launch whereby the angular momentum of the bomb is substantially increased, and its maximum angle of attack due to an angular rate correspondingly reduced, to minimize launch disturbances when the bomb separates from the aircraft.

* * * * *